US010308412B2

(12) United States Patent
Polikeit et al.

(10) Patent No.: US 10,308,412 B2
(45) Date of Patent: Jun. 4, 2019

(54) PACKAGING FILM AND METHOD OF MANUFACTURING SAME

(71) Applicant: JT International S.A., Geneva (CH)

(72) Inventors: Michael Polikeit, Schweich (DE); Juergen Kuempel, Konz (DE); Olaf Janson, Steinhagen (DE)

(73) Assignee: JT International SA (CH)

( * ) Notice: Subject to any disclaimer, the term of this patent is extended or adjusted under 35 U.S.C. 154(b) by 60 days.

(21) Appl. No.: 15/506,120

(22) PCT Filed: Aug. 26, 2015

(86) PCT No.: PCT/EP2015/069532
§ 371 (c)(1),
(2) Date: Feb. 23, 2017

(87) PCT Pub. No.: WO2016/030416
PCT Pub. Date: Mar. 3, 2016

(65) Prior Publication Data

US 2017/0283146 A1 Oct. 5, 2017

(30) Foreign Application Priority Data

Aug. 26, 2014 (EP) ..... 14182284

(51) Int. Cl.
*A24F 15/12* (2006.01)
*B65D 75/58* (2006.01)
(Continued)

(52) U.S. Cl.
CPC ..... *B65D 75/5844* (2013.01); *A24F 15/12* (2013.01); *B65B 61/182* (2013.01);
(Continued)

(58) Field of Classification Search
CPC ..... B65D 75/5844; B65D 75/5833; B65D 75/5827; B65D 75/58; B65D 75/00;
(Continued)

(56) References Cited

U.S. PATENT DOCUMENTS 4,938,363 A 7/1990 Amendola
5,192,262 A * 3/1993 Amendola ..... B29C 59/007 493/364
(Continued)

FOREIGN PATENT DOCUMENTS

DE 102011116285 A1 * 4/2013 ..... B29C 59/007
JP 2010260592 A 11/2010
(Continued)

*Primary Examiner* — Steven A. Reynolds
*Assistant Examiner* — Javier A Pagan
(74) *Attorney, Agent, or Firm* — Lerner, David, Littenberg, Krumholz & Mentlik, LLP

(57) ABSTRACT

The present invention provides a packaging film (1) for use in packaging a consumer product, especially a pack of smoking articles, comprising: an area or expanse (2) of film material configured to cover the consumer product; and opening means (3) formed in the area or expanse (2) of the film material to assist or promote opening or removal of the film when it covers the product in order to access the product, the opening means (3) including at least two frangible seams (5) which extends across at least a portion of the area or expanse (2) of the film material, wherein the at least one frangible seam (5) comprises at least two lines of weakness (7) that extend generally parallel and together define a single, desirably substantially linear, tear path (P).

19 Claims, 1 Drawing Sheet

Figure 1:
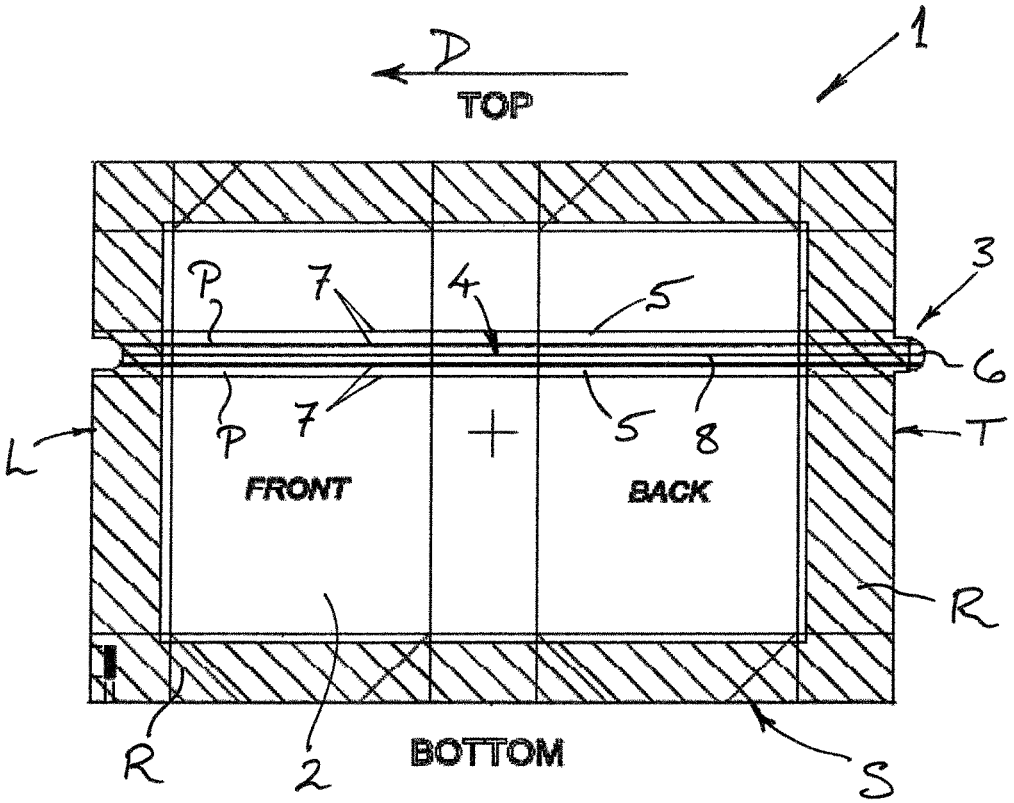

(51) Int. Cl.

| | |
|---|---|
| ***B65D 85/10*** | (2006.01) |
| ***B65B 61/18*** | (2006.01) |
| ***B65D 65/02*** | (2006.01) |
| ***B65D 75/04*** | (2006.01) |

(52) U.S. Cl.
CPC ..... *B65D 65/02* (2013.01); *B65D 75/04* (2013.01); *B65D 75/5805* (2013.01); *B65D 85/10* (2013.01); *B65D 85/1027* (2013.01); *B65D 2203/12* (2013.01)

(58) Field of Classification Search
CPC ..... B65D 75/04; B65D 65/00; B65D 65/02; B65D 65/10; B65D 85/02; B65D 85/07; B65D 85/08; B65D 85/10; A24F 15/00; A24F 15/12; B65B 61/182; B65B 61/18; B65B 61/02
USPC ..... 206/264, 242, 271
See application file for complete search history.

(56) References Cited

U.S. PATENT DOCUMENTS 6,244,435 B1 * 6/2001 Cho ..... B65D 85/1027 206/264
2007/0146142 A1 * 6/2007 Cote ..... B65D 85/10 340/572.8
2007/0193895 A1 * 8/2007 Weiss ..... A24F 15/12 206/259
2007/0246383 A1 * 10/2007 He ..... B65D 7/06 206/268
2010/0221469 A1 * 9/2010 Mills ..... B65D 75/5844 428/35.5
2011/0114103 A1 * 5/2011 Hirai ..... A24F 47/00 131/271
2015/0034507 A1 * 2/2015 Liu ..... A24F 15/12 206/256
2016/0090230 A1 * 3/2016 Dong ..... B65D 85/1045 206/246
2017/0349338 A1 * 12/2017 Ziering ..... B65D 43/22

FOREIGN PATENT DOCUMENTS

WO WO 2006061563 A1 * 6/2006 ..... B65D 5/5213
WO WO 2009010851 A2 * 1/2009 ..... B65D 5/5213
WO WO 2010069672 A1 * 6/2010 ..... B65D 5/5213
WO 2011023385 A1 3/2011
WO WO 2013144921 A1 * 10/2013 ..... B65D 85/1054
WO WO 2013167938 A1 * 11/2013 ..... B65D 85/1036

* cited by examiner

PACKAGING FILM AND METHOD OF MANUFACTURING SAME

This application is a 35 U.S.C. 371 National Stage application of PCT/EP2015/069532, filed Aug. 26, 2015, and claims priority to European Application No. EP 14182284.1, filed on Aug. 26, 2014. The entire contents of the above-mentioned patent applications are incorporated herein by reference as part of the disclosure of this U.S. application.

The present invention relates to a packaging film for use in packaging an item, especially a consumer product to be opened or unpacked by a consumer. The present invention also relates to a method of manufacturing a packaging film, and to a packaged item which incorporates such a film.

Examples of consumer products that are typically packaged in a film material include comestibles and consumables. In such cases, a packaging film will often comprise just one part or component of the packaging. Where the film is comprised of a polymer material, it may form a barrier layer or wrapper to seal and/or to protect the product from external influences, such as air or moisture. One particular example of a consumer product comprising a packaging film is a pack of cigarettes, cigarillos, cigars or the like, which for the sake of brevity and clarity will be collectively referred to herein as simply "smoking articles." While it will be convenient to describe the packaging film and method of the invention with reference to a pack of smoking articles, it will be appreciated that the invention is suitable for use with a wide range of other items or consumer products.

A pack of smoking articles, e.g. cigarette pack, is typically produced in a packing process in which a container or pack is formed or assembled around a charge of the smoking articles. After the packing process, the packs are finally wrapped and sealed with a packaging film that is designed both to protect against external influences and also to retain the aroma and freshness of the smoking articles. Usually the packaging film is a flexible sheet, which is preferably transparent and may be formed of cellophane, polypropylene, or another polymer or synthetic material. The packaging film or barrier film may be heat-shrunk, heat-sealed and/or bonded around the pack.

To assist a consumer to open and/or to remove a packaging film from a packaged item, opening means may be provided to facilitate a consumer opening and/or removing a specific part or region of the film. In this regard, for example, it is known to include opening means in the packaging film of a pack of smoking articles, to enable a consumer to remove at least part of the film in order to open the pack and access the smoking articles after purchase. The opening means may include a line of weakness formed in the film material, e.g. by scoring and/or perforations, and/or a tear tape adhered to the film.

It has been found, however, that when a consumer uses such a known opening means, the breaking or tearing of the film does not always follow the line of weakness or tear line provided. Rather, it has been found that the breaking or tearing of the film may diverge laterally into a surrounding or neighboring area of the packaging film. As a result, a consumer may only achieve an incomplete opening of the packaging. Further, this may create a negative or unsatisfactory user experience for the consumer. It may also damage a part or region of the packaging film intended to be retained on the pack after the pack has been opened.

In view of the above, an object of the present invention is to provide a new and improved packaging film for packaging an item, especially a consumer product such as a pack of smoking articles, which addresses the above problems. Another object is to provide a method of manufacturing that packaging film.

In accordance with this invention, a packaging film having the features recited in claim 1 is provided for packaging items, such as consumer products. Various advantageous and/or preferred features of the invention are also recited in the dependent claims.

According to one aspect, therefore, the invention provides a packaging film for packaging a consumer product, such as a pack of smoking articles, comprising:

- an area or expanse of a film material for covering the consumer product; and
- Opening means formed in the area or expanse of the film material to promote opening or removal of the packaging film when it covers the consumer product to access the consumer product;
- wherein the opening means comprises a pair of frangible seams spaced apart and defining a tear strip therebetween, and
- wherein each frangible seam extends across at least a portion of the area or expanse of the film material and comprises two lines of weakness that extend substantially parallel and together define a single tear path.

By designing the packaging film, and particularly the at least two frangible seams formed each of two lines of weakness and delimiting a tear strip in between, the inventor has developed a configuration with which the opening or tearing of the film has been found to remain confined to the tear path to a significantly greater extent. That is, the tendency of the tearing of the film to break-out or diverge laterally away from the predefined tear path defined by one single frangible seam as in the prior art is significantly reduced. Further the provision the two frangible seams in the opening means further allows to provide a tear strip between the frangible seams which is advantageously larger than the tear tapes or single frangible seams provided in packaging films from the prior art. Such large tear strip helps removing a larger band of material upon tearing of the film, which is therefore stronger along its longitudinal direction parallel to the lines of weakness of the two frangible seams and less subject to diversion from the defined tearing path. The opening quality and reliability is therefore significantly enhanced compared to tear-tape or single frangible seams opening means from the prior art.

It is believed that, even if a user applies pressure to the frangible seams in a direction lateral to the tear path, the at least one of the two lines of weakness can act to absorb a potential divergence and continue the tearing of the film along the desired or predefined tear path. Thus, the fact that the two frangible seams have each two lines of weakness which together form or define the tear path has been found to substantially inhibit an undesired departure of the tearing (laterally) away from the predefined tear path of the seams.

In a preferred embodiment, the lines of weakness of the at least two frangible seam are adjacent and spaced apart from one another by a distance in the range of 0 mm to 5 mm, more preferably in the range of 1 mm to 2 mm, and more preferably in the range of 0.5 mm to 1 mm.

In a preferred embodiment, the tear strip has a width of between about 5 mm and 15 mm, preferably about 10 mm. Such tear strip is much larger than usual tearing bands opening and, as previously explained offers a much stronger tearing strip, which is even less subject to undesired departure of the tearing (laterally) away from the predefined tear path of the seams In a preferred embodiment, each of the lines of weakness comprises a score line and/or a line of perforations formed in the film. In the latter case, the perforations in the adjacent lines of weakness are preferably at least partially offset from one another along the tear path they define. In this way, it is believed that the offset perforations enable the tearing to remain confined to the defined tear path, even under the influence of pressure being exerted by a user in a lateral direction.

In a particularly preferred embodiment, the frangible seams extend on opposite sides of the tear strip substantially parallel to one another, wherein the tear strip preferably or optionally includes a tear tape or tear thread attached or bonded thereto to assist force transfer to the frangible seams. The tear tape or tear thread is preferably coextensive with the tear strip.

In a particularly preferred embodiment of the packaging film, the opening means includes an operator means provided to be operated by a user to activate or to break the at least two frangible seams. In this regard, the operator means may be a tab or flap to be grasped or held and then drawn or pulled by a user for activating or operating the at least two frangible seams. In this regard, the tab or flap is typically provided at one end region of the tear strip to assist a user to initiate tearing or breaking of the film material. As an alternative, or in addition, the operator means may include a tear tape or tear thread attached or bonded to the film along the at least one frangible seam to assist force transfer to the frangible seam.

In a preferred embodiment, the film material comprises a flexible, preferably transparent sheet formed of cellophane, polypropylene, or another polymer or synthetic material. The area or expanse of the film material is usually rectangular.

According to another aspect, the invention provides a method of manufacturing a packaging film for packaging a consumer product, especially a pack of smoking articles, the method comprising the steps of:

providing a sheet of film material;

defining at least one area or expanse of the sheet of film material for wrapping around a product to be packaged; and forming opening means in the area or expanse of the film material to promote opening or removal of the film material from the product, the opening means comprising two frangible seams defining a tear strip there-between, such that the two frangible seams extend on opposite sides of the tear strip, wherein the step of forming each of the frangible seams comprises forming two lines of weakness that extend generally parallel and together define a single tear path.

In a preferred embodiment, the method includes forming the two lines of weakness of the frangible seams adjacent one another and spaced apart in the range of 0 mm to 5 mm, more preferably in the range of 1 mm to 2 mm, and even more preferably in the range of 0.5 mm to 1 mm.

In a particularly preferred embodiment, comprising forming a tear strip having a width of between about 5 mm and 15 mm between the two frangible seams, preferably a width of about 10 mm In a preferred embodiment, the step of forming the lines of weakness includes scoring (e.g. laser scoring) or perforating (e.g. laser perforating) the line of weakness across the area or expanse of the film material. Any such perforations in the respective lines of weakness are desirably at least partially offset from one another along the tear path defined.

Preferably, also, the method further comprises the step of forming a tab or flap to be gripped and drawn by a user for operating the tear strip. That tab or flap is typically at an end region of the frangible seam or an end region of the tear strip.

According to a further aspect, the present invention provides a packaged item, especially a consumer product such as a pack of smoking articles, comprising a packaging film as described with respect to any one of the embodiments above, preferably as an outer wrapping.

Figure 2:
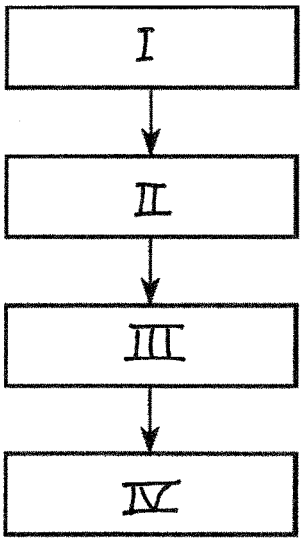

For a more complete understanding of the invention and the advantages thereof, exemplary embodiments of the invention are explained in more detail in the following description with reference to the accompanying drawing figures, in which like reference characters designate like parts and in which:

FIG. 1 shows a plan view of a flat sheet of a packaging film for use packaging a pack of smoking articles according to one particular embodiment; and FIG. 2 is a flow diagram that schematically illustrates a method according to a preferred embodiment.

The accompanying drawings are included to provide a further understanding of the present invention and are incorporated in and constitute a part of this specification. The drawings illustrate particular embodiments of the invention and together with the description serve to explain the principles of the invention. Other embodiments of the invention and many of the attendant advantages of the invention will be readily appreciated as they become better understood with reference to the following detailed description.

It will be appreciated that common and well understood elements that may be useful or necessary in a commercially feasible embodiment are not necessarily depicted in order to facilitate a more abstracted view of the embodiments. The elements of the drawings are not necessarily illustrated to scale relative to each other. It will further be appreciated that certain actions and/or steps in an embodiment of a method may be described or depicted in a particular order of occurrences while those skilled in the art will understand that such specificity with respect to sequence is not actually required. It will also be understood that the terms and expressions used in the present specification have the ordinary meaning as is accorded to such terms and expressions with respect to their corresponding respective areas of inquiry and study, except where specific meanings have otherwise been set forth herein.

Referring to drawing FIG. 1, a packaging film 1 according to a preferred embodiment of the invention is shown as a flat, generally rectangular sheet S having a predefined area or expanse 2 which is specifically designed or configured to be wrapped around a generally rectangular pack (not shown) of cigarettes, cigarillos or other such smoking articles by a wrapping device. In this regard, FIG. 1 identifies those regions or portions of the packaging film area or expanse 2 which correspond to the "front" and "back" faces of the pack of smoking articles. Furthermore, a peripheral outer region R of the packaging film sheet S (i.e. which is cross-hatched or shaded) denotes the portions or regions of the sheet S that overlap for bonding to one another after the pack has been wrapped with the film 1.

The individual sheet S of the packaging film 1 illustrated in FIG. 1 of the drawings may be provided as one of a series of sheets in a continuous roll of packaging film material 1. That is, the roll may include a plurality of such sheets S joined to one another in series along respective leading and trailing edges thereof L, T with reference to a travel direction (as indicated by the arrow "D") for the film being fed from a bulk roll into a wrapping device of a packaging apparatus (not shown). Typical dimensions for the sheet S of packaging film 1 in FIG. 1 for application to a typical pack of smoking articles are about 113 mm width and 170 mm length. However, it will be appreciated by persons skilled in the art that such dimensions are merely indicative of one particular embodiment of the invention and that these dimensions may differ in other embodiments without having any influence on the inventive concept. The packaging film 1 in this specific example is desirably comprised of a transparent polypropylene material.

As seen in FIG. 1, the sheet S of packaging film 1 includes an opening means 3 comprising a tear strip 4 having a width of about 10 mm formed between two frangible seams 5.

The opening means 3 further includes a tab or flap 6 is provided at one end region of this tear strip 4 as an activation means for a user to grasp and pull for activating the tear strip 4 so as to break or tear the packaging film 1 along the two frangible seams 5. Each of the frangible seams 5 defines a tear path P from the tab or flap 6 to the other end of the tear strip 4. Furthermore, each of the frangible seams 5 comprises a pair of lines of weakness 7 that together define the tear path P and are spaced apart in parallel by a distance of in the range of about 3 mm to 5 mm. Each of the lines of weakness 7 is preferably pre-formed in the film material by laser perforation and/or by laser scoring. Such perforation and/or scoring to form the lines of weakness 7 advantageously allows generation of a sound upon activating the opening means 3 along the frangible seams 5. Such sound generation provides proper indication of a correct opening of the film along the tear paths P.

The width of the tear strip 4 between the two frangible seams 5 is preferably be comprised between about 5 mm and 15 mm to provide a large tearing band in the film 1. Such larger band provides increased strength to the tear strip 4 in its longitudinal direction defined as the direction of extension of said tearing strip 4 parallel to the tear paths P defined by the frangible seams 5. This advantageously provides for easier and more controlled opening of the film as described later.

The packaging film 1 may further include a tear-tape in the tear strip 4 between the frangible seams 5; i.e. between the lines of weakness 7 of each of the frangible seams 5, and in particular those defining the longitudinal edges of the tear strip 4. Preferably, the tab or flap 6 is formed such that it is provided in the sheet S of packaging film at a position between lines of weakness 7, and especially between the pairs of lines of weakness 7 of the two frangible seams 5. Such an intermediate arrangement of the tab or flap 6 is particularly advantageous to ensure that the opening means 3 is activated for opening the packaging film 1 along the frangible seams 5, the sheet S being cut by default along at least one of the lines of weakness 7 of each of the frangible seams 5.

Referring now to FIG. 2 of the drawings, a flow diagram is shown that schematically illustrates the steps in a method of manufacturing a packaging film 1 according to the embodiment of the invention described above with respect to FIG. 1. In this regard, the first box I of FIG. 2 represents the step of providing a sheet S of film material, such as cellophane, polypropylene, or another polymer material. The sheet S may, for example, be elongate and be in the form of a roll of film material. The second box II then represents the step of defining at least one area or expanse 2 of the polymer film material for wrapping around a product to be packaged, such as a pack of smoking articles. In this regard, the area or expanse 2 may be specifically shaped and dimensioned for the particular consumer product of interest. The third box III represents the step of forming an opening means 3 in the area or expanse 2 of the film material to promote opening or removal of the packaging film from the product, the opening means 3 comprising a first frangible seam 5 which extends across at least a portion of each area or expanse 2 of the film material. In this regard, forming the first frangible seam 5 comprises the step of forming two lines of weakness 7 that extend generally parallel to one another and together define a single tear path P. The final box IV in FIG. 2 of the drawings represents the additional step in the formation of the opening means 3 of forming a second frangible seam 5 comprising two lines of weakness 7 that extend parallel to one another and together define another tear path P; i.e. of this second frangible seam 5. In this embodiment, therefore, the method produces a tear strip 4 defined between the first and second frangible seams 5, said tear strip 4 having a width of about 5 mm to 15 mm, preferably about 10 mm. That is, the two frangible seams 5 extend substantially parallel to one another on opposite sides of the tear strip 4.

Although specific embodiments of the invention have been illustrated and described herein, it will be appreciated by those of ordinary skill in the art that a variety of alternative and/or equivalent implementations exist. In this regard, it will be noted that the shape of the item to be packaged is not critical to the invention. Cigarette packs will typically have a rectangular shape, but other shapes are also conceivable. It should be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Accordingly, this application is intended to cover any adaptations or variations of the specific embodiments discussed herein.

Also, it will be appreciated that in this document, the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

LIST OF REFERENCE SIGNS

1 packaging film
2 area or expanse of the film material
3 opening means
4 tear strip
5 frangible seam
6 tab or flap
7 line of weakness
8 tear tape S sheet
P tear path
R edge regions for overlap and bonding
D travel direction of barrier film sheet
L leading edge of barrier film sheet
T trailing edge of barrier film sheet

The invention claimed is:

1. A packaging film for packaging a consumer product, such as a pack of smoking articles, comprising:

an area or expanse of a film material for covering the consumer product; and opening means formed in the area or expanse of the film material to promote opening or removal of the packaging film when it covers the consumer product to access the consumer product;

wherein the opening means comprises a pair of frangible seams spaced apart and defining a tear strip there-between, and wherein each frangible seam extends across at least a portion of the area or expanse of the film material and comprises two lines of weakness that extend substantially parallel and together define a single tear path, and wherein each of the lines of weakness comprises a line of perforations formed in the film, wherein the perforations in the respective lines of weakness are at least partially offset from one another along the tear path they define.

2. A packaging film according to claim 1, wherein the single tear path defined by the two lines of weakness is substantially linear.

3. A packaging film according to claim 1, wherein the lines of weakness of the frangible seams are adjacent one another and spaced in the range of 0 mm to 5 mm apart.

4. A packaging film according to claim 3, wherein the lines of weakness of the frangible seams are spaced in the range of 1 mm to 2 mm apart.

5. A packaging film according to claim 3, wherein the lines of weakness of the frangible seams are spaced in the range of 0.5 mm to 1 mm apart.

6. A packaging film according claim 1, wherein the tear strip has a width of between about 5 mm and 15 mm.

7. A packaging film according claim 6, wherein the width of the tear strip is about 10 mm.

8. A packaging film according claim 1, wherein the frangible seams extend on opposite sides of the tear strip substantially parallel to one another.

9. A packaging film according claim 8, wherein the tear strip includes a tear tape bonded thereto.

10. A packaging film according to claim 1, wherein the opening means includes a tab or flap to be gripped and drawn by a user for activating the at least two frangible seams.

11. A packaging film according to claim 10, wherein the tab or flap is provided in or connects to a sheet of the packaging film at a position between the lines of weakness of the two frangible seams.

12. A packaging film according to claim 10, wherein the tab or flap is provided in or connects to a sheet of the packaging film at a position between two lines of weakness.

13. A packaging film according to claim 1, wherein the film comprises a flexible, transparent sheet formed of cellophane, polypropylene, or another polymer or synthetic material, the area or expanse thereof being generally rectangular.

14. A packaged consumer product, such as a pack of smoking articles, comprising the packaging film according to claim 1 as an outer wrapping.

15. A method of manufacturing a packaging film for use packaging a consumer product, such as a pack of smoking articles, the method comprising:

providing a sheet of film material;

defining at least one area or expanse of the film material for wrapping around a product to be packaged; and forming an opening means in the at least one area or expanse of the film material to promote opening or removal of the film material from the product, the opening means comprising two frangible seams defining a tear strip there-between, such that the two frangible seams extend on opposite sides of the tear strip, wherein the step of forming each of the frangible seams comprises forming two lines of weakness that extend generally parallel and together define a single tear path, wherein the step of forming the lines of weakness comprises perforating the line of weakness across the area or expanse of the film material, wherein the perforations in the respective lines of weakness are at least partially offset from one another along the tear path they define.

16. A method according to claim 15, wherein the two lines of weakness of the two frangible seams are formed adjacent one another and spaced in the range of 0 mm to 5 mm apart.

17. A method according to claim 15, comprising forming the tear strip having a width of between about 5 mm and 15 mm between the two frangible seams.

18. A method according to claim 15, further comprising the step of forming a tab or flap to be gripped and drawn by a user for operating the tear strip.

19. A packaged consumer product, such as a pack of smoking articles, comprising the packaging film according to claim 15 as an outer wrapping.

* * * * *